US005273853A

United States Patent [19]

Urano et al.

[11] Patent Number: 5,273,853

[45] Date of Patent: Dec. 28, 1993

[54] BLACK PHOTOCONDUCTIVE TONER HAVING SENSITIVITY TO LIGHT IN THE WAVELENGTH RANGE OF SEMICONDUCTOR LASERS

[75] Inventors: Akiyoshi Urano, Takarazuka; Yumiko Sano, Ibaraki; Seiji Kado, Minoo; Kazushige Inoue, Takatsuki, all of Japan

[73] Assignee: Mita Industrial Co., Ltd., Osaka, Japan

[21] Appl. No.: 536,841

[22] Filed: Jun. 12, 1990

[30] Foreign Application Priority Data

| | | | |
|---|---|---|---|
| Jun. 13, 1989 | [JP] | Japan | 1-150936 |
| Nov. 29, 1989 | [JP] | Japan | 1-310203 |
| Nov. 29, 1989 | [JP] | Japan | 1-310206 |
| Nov. 29, 1989 | [JP] | Japan | 1-310207 |
| Nov. 29, 1989 | [JP] | Japan | 1-310208 |

[51] Int. Cl.[5] ..... G03G 9/00

[52] U.S. Cl. ..... 430/106; 430/45; 430/137

[58] Field of Search ..... 430/137, 45, 106

[56] References Cited

U.S. PATENT DOCUMENTS

| | | | |
|---|---|---|---|
| 4,567,125 | 1/1986 | Moroni | 430/59 |
| 4,668,600 | 5/1987 | Lingnau | 430/83 |
| 4,921,768 | 5/1990 | Kunugi et al. | 430/45 |

*Primary Examiner*—Marion E. McCamish
*Assistant Examiner*—S. Rosasco
*Attorney, Agent, or Firm*—Armstrong, Westerman, Hattori, McLeland & Naughton

[57] ABSTRACT

A black photoconductive toner having sensitivity to light in the wavelength range of semiconductor lasers, the toner containing a resinous binder, photoconductive material, a sensitizer, and a perylene black pigment or yellow, magenta, or cyan quinone dyes.

13 Claims, No Drawings

BLACK PHOTOCONDUCTIVE TONER HAVING SENSITIVITY TO LIGHT IN THE WAVELENGTH RANGE OF SEMICONDUCTOR LASERS

BACKGROUND OF THE INVENTION

1. Field of the invention:

The present invention relates to a black photoconductive toner which has a good electrification property and photoconductivity, and exhibits excellent sensitivity to light in the wavelength range of semiconductor lasers.

2. Description of the prior art:

A copy image forming method using photoconductive toner has been attracting attention in recent years as a method of forming a copy image without using a photoconductor drum. The photoconductive toner is a toner prepared by dispersing or dissolving a photoconductive material, a sensitizer, etc. in a resinous binder and granulating such a mixture using a grinding or spray-dry technique. The toner is by itself provided with photoconductivity.

The following describes one example of an image forming method using such a photoconductive toner. In this method, the following steps (1) to (4) are sequentially performed:

(1) Charged photoconductive toner is made to adhere uniformly onto a conductive base, thereby forming a toner layer on the surface thereof. (2) An image exposure is performed. (3) A copy paper is superposed on the toner layer, and corona discharge is applied from the back of the copy paper to transfer the toner image onto the copy paper. (4) The transferred image is fixed to the copy paper.

In the above process, since the photosensitivity of the photoconductive toner is generally low, only a small difference is created between the electric charge of the exposed portion and that of the unexposed portion of the latent image formed through the exposure. To increase the difference in the electric charges, a method has been tried to apply corona discharge over the toner layer for enhancement of the surface potential thereof. This method, however, has not necessarily been successful in resolving the above shortcoming. Raising the proportion of the photoconductive material in the toner to enhance the photoconductivity of the toner has also been considered. This has in turn caused a deterioration of the electrification property of the toner, and as a result, led to a drop in the photosensitivity of the toner. It is therefore desired to develop a photoconductive toner which has a good electrification property and photoconductivity, and exhibits excellent photosensitivity.

The image forming system using the photoconductive toner has recently come to be considered for application to laser printers, in addition to the conventional application to analog image forming apparatus, because of the advantage that the entire apparatus can be designed to be extremely compact. Previously, gas lasers were used as the laser light source for the exposure system of laser printers. In recent years, however, semiconductor lasers are extensively used as the laser light source, since they have many advantages such as high and stable laser light intensity, directly controllable laser light intensity, low cost, etc. As the semiconductor laser produces a laser light having wavelengths in the range of 780 to 850 nm, i.e., in the near infrared to the infrared regions, researches are being carried out into photoconductive materials which have good sensitivity to light with the wavelengths in the range of 780 to 850 nm, pigments which are used as sensitizers to shift the photosensitivity range of the toner to the region of infrared light, and so on.

It has previously been proposed to shift the photosensitivity range of the toner to the region of infrared light by using zinc oxide as the photoconductive material and a cyanine pigment as the sensitizer. In this case however, the toner containing zinc oxide, a cyanine pigment, and a resinous binder gives a bluish green color, not black, therefore, it may be necessary to add a black pigment as a colorant. If carbon black, which is generally used as a black pigment, is added to the toner, the photosensitivity of the toner will drop, since carbon black absorbs light having wavelengths in the range of 780 to 850 nm, which is the wavelength range of the semiconductor lasers.

A method has also been considered to prepare a black toner using a developer and a heat sensitive black pigment which does not absorb light having the wavelength in the vicinity of 780 nm, but it has been found that this method causes a marked drop in the electrification property of the toner. Since the heat sensitive black pigment generally has lactone rings, it adheres to the surface of zinc oxide when the rings open because of coloring action, thus hampering the adhesion of the cyanine pigment.

SUMMARY OF THE INVENTION

The present invention provides a black photoconductive toner having sensitivity to light in the wavelength range of semiconductor lasers, which overcomes the above-discussed and numerous other disadvantages and deficiencies of the prior art, the toner containing a resinous binder, photoconductive material, a sensitizer, and a perylene black pigment.

In a preferred embodiment, the perylene black pigment is expressed by the following formula (I):

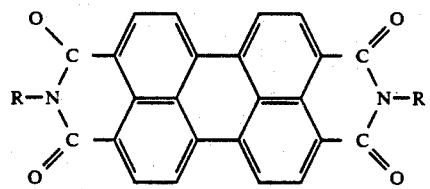

(I)

wherein R is

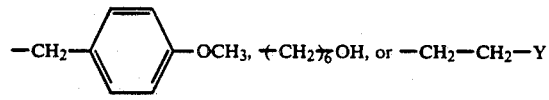

(Y represents a phenyl, methyl, or hydroxymethyl group).

In a preferred embodiment, the sensitizer is a cyanine pigment.

In a preferred embodiment, the photoconductive material is an inorganic photoconductive material.

In a preferred embodiment, the inorganic photoconductive material is zinc oxide.

In a preferred embodiment, the toner further contains a magenta pigment.

In a preferred embodiment, the toner further contains at least one of yellow, magenta, and cyan quinone dyes having no functional groups.

In a preferred embodiment, the inorganic photoconductive material is colored by the sensitizer which absorbs light having wavelengths in the visible region.

The present invention also provides a black photoconductive toner having sensitivity to light in the wavelength range of semiconductor lasers, the toner containing a resinous binder, a photoconductive material, a sensitizer, and yellow, magenta, and cyan quinone dyes having no functional groups.

In a preferred embodiment, the conditioner is a cyanine pigment.

In a preferred embodiment, the photoconductive material is an inorganic photoconductive material.

In a preferred embodiment, the inorganic photoconductive material is zinc oxide.

In a preferred embodiment, the toner further contains a perylene black pigment.

In a preferred embodiment, the toner further contains a magenta pigment.

In a preferred embodiment, the inorganic photoconductive material is colored by the sensitizer which absorbs light having a wavelength range in the visible region.

Thus, the invention described herein makes possible the objectives of:

(1) providing a black photoconductive toner which has a good electrification property and photoconductivity, and exhibits excellent sensitivity to light in the wavelength range of semiconductor lasers (in the vicinity of 780 nm);

(2) providing a black photoconductive toner having a black hue; and (3) providing a black photoconductive toner in which a hypochromic inorganic material can be used as a photoconductive material.

DESCRIPTION OF THE PREFERRED EMBODIMENTS

As a resinous binder used in the present invention, a prior known resin is used, which includes, for example, styrene polymer, styrene-butadiene copolymer, styrene-acrylonitrile copolymer, styrene-maleic acid copolymer, acrylic polymer, styrene-acrylic copolymer, ethylene-vinyl acetate copolymer, polyvinyl-chloride, vinyl chloride-vinyl acetate copolymer, polyester, alkyd resin, polyamide, polyurethane, acryl denatured urethane resin, epoxide resin, polycarbonate, polyarylate, polysulfone, diallyl phthalate resin, silicone resin, ketone resin, polyvinyl butyral resin, polyether resin, phenol resin, etc.

As a photoconductive material used in the present invention, such inorganic photoconductive materials as zinc oxide, titanium oxide, cadmium sulfide, and cadmium oxide are preferable. Among them, zinc oxide is particularly preferable in that it provides good memory and high photosensitivity. It is preferred that the photoconductive material is contained in the proportion of 1:1 to 5:1 (weight ratio) with respect to the resinous binder, more preferably, within the range of 2:1 to 3:1 (weight ratio).

In the present invention, a colored hypochromic inorganic photoconductive material may also be used. The photoconductive material may be colored by a sensitizer which absorbs light having wavelengths in the visible region. The sensitizer is a chromatic pigment, such as Erythrosine B. fluorescein, Bromophenol Blue, etc. Also, the hypochromic inorganic photoconductive material is a white or light-colored inorganic photoconductive material, such as zinc oxide, titanium oxide, etc. Zinc oxide is particularly preferred for use because of its good memory and high photosensitivity. When the zinc oxide is colored by Erythrosine B for example, it gives a dark pink color. Likewise, it gives color extending from yellow to skin color (light yellow) when colored by fluorescein, and from light purple to blue when colored by Bromophenol Blue. More than one kind of pigment may be used to color the photoconductive material. For example, when colored by pigments of a three-color mixture, the photoconductive material gives a black hue, which serves to hide the white color components contained in the inorganic photoconductive material.

The toner of this invention may also contain a sensitizer which is sensitive to light in the near infrared to the infrared regions. As the sensitizer, a cyanine pigment is preferable. The cyanine pigment includes, for example, the ones shown below.

(1) Cyanine pigment represented by the following general formula (A):

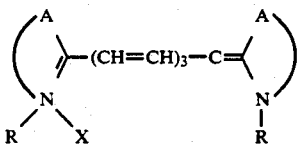

(A)

wherein R is $CH_3$, $C_2H_5$, $CH_2COOH$, $C_3H_4COOH$, or $CH_2$—$CHCH_2$; X is I, Br, Cl, $ClO_4$, or

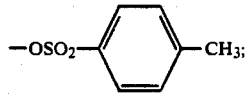

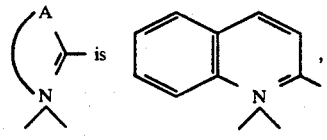

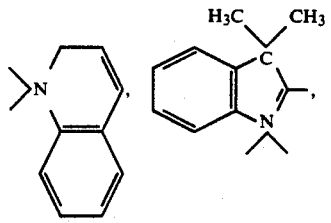

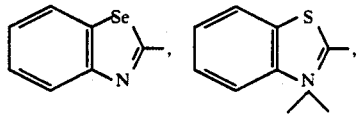

-continued

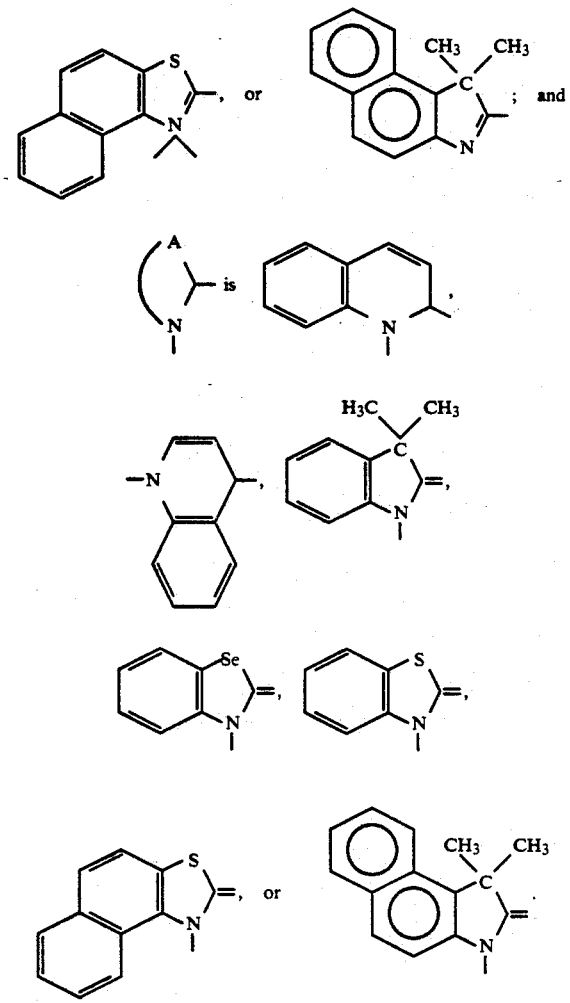

(2) Cyanine pigment represented by the following formula (B):

(B)

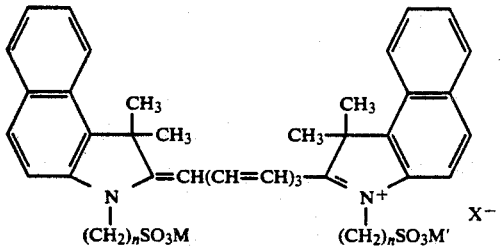

wherein n is an integer in the range of 1 to 7; M and M' are selected independently with each other from groups of hydrogen atoms and alkaline metals, and X is an anion in an acid.

Any of the above cyanine pigments may be used singly, or in combination with each other. The sensitizer is added preferably in 0.05 to 0.3% by weight with respect to the photoconductive material, and more preferably, within the range of 0.1 to 0.2% by weight.

Furthermore, the toner of the present invention may contain at least one kind of dye selected from a group of yellow, magenta, and cyan quinone dyes. Each of these dyes does not have in its molecule any functional groups (reactive groups) such as hydroxyl, carboxyl, amino, or sulfoxyl groups.

The quinone yellow dye includes, for example, an Indanthrene Yellow BY, etc. The quinone cyan dye includes, for example, an Alizarine Brilliant Pure Blue, etc. Also, the quinone magenta includes, for example, an Indanthrene Red 5gk, etc.

Since the above dyes do not have functional groups, there is no possibility of the dyes adhering to the photoconductive material when they are mixed with the photoconductive material such as zinc oxide. This means that the dyes do not hamper the adhesion of sensitizers such as cyanine pigments to the photoconductive material. Therefore, no substantial drop is caused in the photoconductivity of the black toner thus prepared. On the other hand, quinone dyes having functional groups, such as Suprance-Violet 4BF, Anthracene Blue SWGG, etc., strongly react with the photoconductive material and hamper the adhesion of cyanine pigments to the photoconductive material, thus causing a drop in the photosensitivity of the toner.

When the above three color dyes are mixed together, a black dye is obtained. The hue of the toner can be adjusted by controlling the mixing ratio of these three color dyes.

The toner of the present invention may also contain a perylene black pigment. The perylene black pigment is a black pigment which hardly absorbs light, having wavelengths in the range of 780 to 850 nm, i.e., in the laser light wavelength range. More specifically, perylene-3,4,9,10-tetracarboxylic acid diimide, etc. expressed by the following formulae (C), (D) and (E) are some of the examples.

(C)

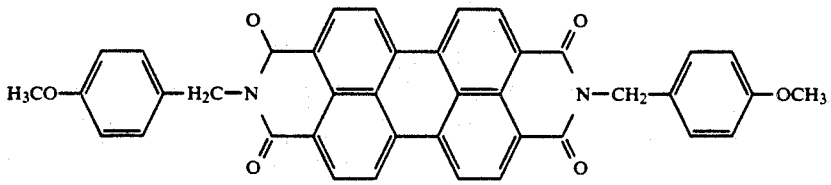

-continued (D)

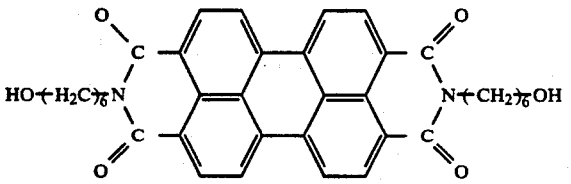

(E)

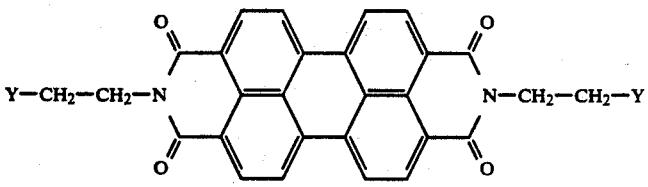

In the formula (E), Y is a phenyl, methyl, or hydroxymethyl group.

The perylene black pigment represented by the above formula (C) is obtained by reacting perylene-3,4,9,10-tetracarboxylic acid or its di-anhydride with 4-methoxy-benzylamine in water, or in an organic solvent, under high temperature or in some cases under pressure, using a known method. The details of such a method is disclosed, for example, in Japanese Laid-open Patent Publication No.57-139144.

The perylene black pigment represented by the above formula (D) is obtained by reacting perylene-3,4,9,10-tetracarboxylic acid or its di-anhydride with 6-hydroxyhexylamine in water, or in an organic solvent, under high temperature, or in some cases under pressure, using a known method. The details of such method are disclosed for example, in Japanese Laid-open Patent Publication No.62-1753.

The perylene black pigment represented by the above formula (E) is obtained by reacting perylene-3,4,9,10-tetracarboxylic acid or its di-anhydride with a corresponding amine in water, or in an organic solvent, under high temperature, or in some cases under pressure, using a known method. The details of such a method is disclosed for example in Japanese Laid-open Patent Publication No.52-103450.

The above-mentioned perylene black pigments may be either refined or unrefined for use, or may be refined in the form of fine particles for use. For refining, the pigments are precipitated, using sulfuric acid, or unrefined pigments are first ground, and then recrystallized from the water, organic solvent or from their mixture.

Any of these perylene black pigments may be used singly, or in combination with one another. The perylene black pigments are added preferably in 1 to 30% by weight with respect to the resinous binder, more preferably within the range of 5 to 15% by weight, and still more preferably 5 to 10% by weight. If the perylene black pigments are added in a larger percentage than that prescribed above, the electrification property of the toner will be lowered, causing a slight decrease in its photosensitivity. On the other hand, if the perylene black pigments are added in less amounts than the above range, sufficient black coloring effects will not be obtained.

When the perylene black pigments are used along with the aforementioned dye mixture, it is desirable that the combined amount of these colorants is contained in the toner within the range of 1 to 30% by weight with respect to the resinous binder, preferably 5 to 15% by weight. In the mixture of these colorants, the weight ratio of the dyes to the perylene black pigments should be preferably within the range of 1:1 to 1:3. If the dyes are added in a greater proportion than prescribed above, the opacifying power of the toner will tend to drop. Conversely, if the dyes are added in a smaller proportion, the toner hue tends to take on a greenish color, not the desired black.

The toner of the present invention may contain a magenta pigment which does not absorb light having wavelengths in the vicinity of 780 nm, in order to compensate for the toner hue. For such a purpose, already known compounds can be used, such as quinacridone pigment, rhodamine pigment, thioindigo pigment, and azo pigment. The magenta pigments commercially available and suitable to use for the purpose include Paliogen Red 3910HD (produced by BASF Co., Ltd.), Paliogen Red 3870HD (produced by BASF Co., Ltd.), Chromofine Magenta MT201 (produced by Dainichi Seika Co., Ltd.), Hostapern Pink E-02 (produced by Hoechst Co., Ltd.), Brilliant Carmine FB Pure (produced by Yamazaki Co., Ltd.), Permanent Link (produced by Sanyo Co., Ltd.), and Perylene Red (produced by Mikuni Co., Ltd.). The magenta pigments expressed by the following formulas (F) and (G) are particularly preferable.

(F)

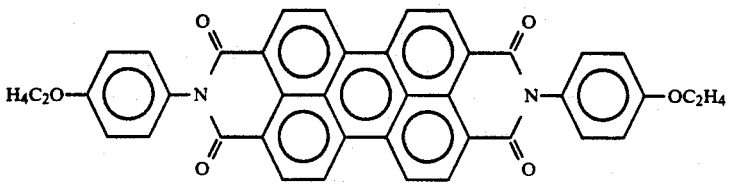

Paliogen Red L 3870HD
(produced by BASF Co., Ltd.)

-continued (G)

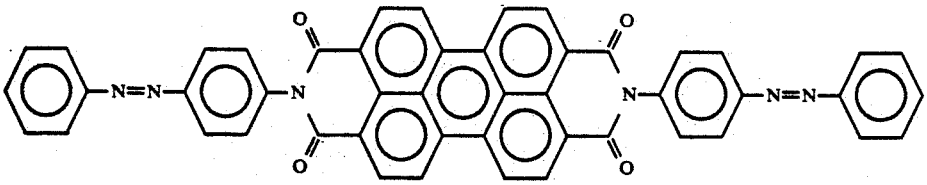

Paliogen Red L 3910HD
(produced by BASF Co., Ltd.)

It is preferable that such magenta pigments are added in 10 to 40% by weight, with respect to the perylene black pigments, preferably within the range of 15 to 30% by weight.

When the perylene black pigments are thus used along with the magenta pigments, compensation for the toner hue is accomplished, and a toner having a hue further close to black can be obtained.

Furthermore, the toner of the present invention may contain known offset inhibitors such as waxes and assistants such as pressure fixing additives.

The toner of the present invention comprises, as indispensable components, a resinous binder, a photoconductive material, a sensitizer, and a perylene black pigment or three-color quinone dye mixture having no functional groups, with the above-mentioned components for compensating for the toner hue added as necessary, and is prepared by dispersing or dissolving these materials in a solution and granulating the thus obtained mixture using a grinding technique or a spray-dry technique.

The toner containing the perylene black pigments can provide black coloring effects without absorbing lights with the wavelengths in the wavelength range of semiconductor lasers and without adversely affecting the photoconductive material.

The toner containing the perylene black pigments and magenta pigments can provide a further black hue to the toner.

In the toner containing the perylene black pigments and at least one of the yellow, magenta, and cyan quinone dyes, the dye mixture serves to provide a black hue to the toner and gives the toner good electrification property and photoconductivity.

In the toner containing the colored inorganic photoconductive material, the colorant serves to hide the white color components contained in the inorganic photoconductive material, thus readily giving a black hue to the toner.

In the present invention, "high photosensitivity" means that sufficient difference is provided between the initial surface potential of the charged toner layer and the decreased surface potential of the toner layer after exposure (light radiation).

EXAMPLES

The following describes the present invention with respect to the examples.

Example 1

After dispersing and mixing the following components, a black photoconductive toner having an average article size of 10 to 11 μm was obtained from the mixture, using a spray-dry technique:

| Component | Parts by weight |
|---|---|
| Zinc oxide: SOX 100 (Trademark; produced by Seido Kagaku Co., Ltd.) | 100 |
| Styrene-acryl resin: PA-525 (Trademark; produced by Mitsui Toatsu Chemical Co., Ltd.) | 33 |
| Perylene black pigment: Paliogen Black L0084 | 5 |
| Cyanine pigment | 0.1 |
| Toluene | 1000 |

With the above as the basic prescription, the cyanine pigment (NK1967 produced by Nippon Kankoh Shikiso Kenkyusho Co., Ltd.) represented by the following formula was used.

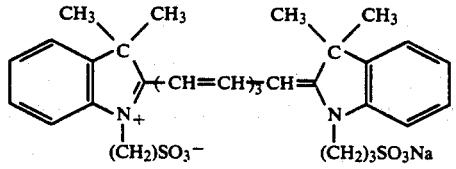

Example 2

A black photoconductive toner having an average particle size of 10 to 11 μm was obtained in the same manner as in Example 1, except that the cyanine pigment (NK1414 produced by Nippon Kankoh Shikiso Kenkyusho Co., Ltd.) represented by the following formula was used.

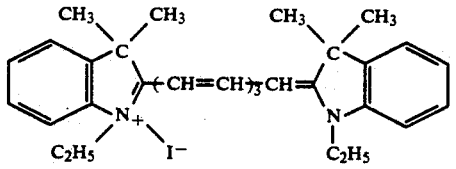

Example 3

A black photoconductive toner having an average particle size of 10 to 11 μm was obtained in the same manner as in Example 1, except that the cyanine pigment (NK2014 produced by Nippon Kankoh Shikiso Kenkyusho Co., Ltd.) represented by the following formula was used.

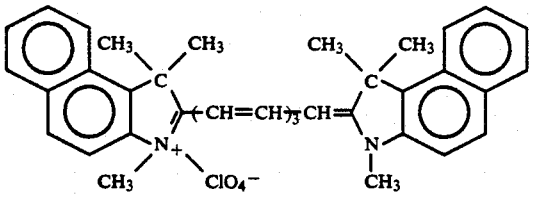

Comparative Example 1

A photoconductive toner having an average particle size of 10 to 11 μm was obtained in the same manner as in Example 1, except that 5 parts by weight of heat sensitive black pigment TG11 (Trademark; produced by Nippon Kayaku Co., Ltd.) and 5 parts by weight of developer TG-SAI (Trademark; produced by Nippon Kayaku Co., Ltd.) were used instead of the perylene black pigment.

Comparative Example 2

A photoconductive toner having an average particle size of 10 to 11 μm was obtained in the same manner as in Example 2, except that 5 parts by weight of heat sensitive black pigment TG11 (Trademark; produced by Nippon Kayaku Co., Ltd.) and 5 parts by weight of developer TG-SAI (Trademark; produced by Nippon Kayaku Co., Ltd.) were used instead of the perylene black pigment.

Comparative Example 3

A photoconductive toner having an average particle size of 10 to 11 μm was obtained in the same manner as in Example 3, except that 5 parts by weight of heat sensitive black pigment TG11 (Trademark; produced by Nippon Koyoku Col, Ltd.) and 5 parts by weight of developer TG-SAI (Trademark; produced by Nippon Kayaku Co., Ltd.) were used instead of the perylene black pigment.

Comparative Example 4

A photoconductive toner having an average particle size of 10 to 11 μm was obtained in the same manner as in Example 1, except that the perylene black pigment was not used.

Comparative Example 5

A photoconductive toner having an average particle size of 10 to 11 μm was obtained in the same manner as in Example 2, except that the perylene black pigment was not used.

Comparative Example 6

A photoconductive toner having an average particle size of 10 to 11 μm was obtained in the same manner as in Example 3, except that the perylene black pigment was not used.

Next, each of the black photoconductive toners obtained by Examples 1-3 and Comparative Examples 1-6 was mixed with ferrite carrier to charge them through friction, resulting in a developer. Then, the thus obtained developer was fed into a magnetic brush developer unit of an electrophotographic copying machine, and the photoconductive toner was made to adhere uniformly onto an aluminum board to form a toner layer on the surface thereof. Next, monochromatic light (780 nm) produced by a monochromator was radiated over the toner layer for 0.5 seconds. The surface potential before the radiation and the surface potential 1.0 second after the radiation were measured to measure the attenuation rate of the surface potential (the maximum attenuation rate of the surface potential) using a computer connected to a digital oscilloscope. Also, the electric charge of each photoconductive toner was measured using a blowoff technique. The results are shown in Table 1.

TABLE 1

| | Surface potential attenuation rate (%) | Electric charge (μc/g) |
|---|---|---|
| Example 1 | 12.7 | 13 |
| Example 2 | 36.0 | 11 |
| Example 3 | 28.5 | 11 |
| Comparative Example 1 | 5.2 | 6 |
| Comparative Example 2 | 2.4 | 5 |
| Comparative Example 3 | 1.3 | 5 |
| Comparative Example 4 | 12.6 | 14 |
| Comparative Example 5 | 36.2 | 12 |
| Comparative Example 6 | 29.8 | 12 |

It can be seen from Table 1 that each black photoconductive toner containing the perylene black pigment demonstrates a large surface potential attenuation rate, as do the uncolored toners, and does not adversely affect the photosensitivity of the toner.

Example 4

| Component | Parts by weight |
|---|---|
| Zinc oxide: Grade#2 (produced by Hakusui Kagaku Co., Ltd.) | 100 |
| Styrene-acryl resin: PA-525 (produced by Mitsui Toatsu Chemical Co., Ltd.) | 33 |
| Perylene black pigment: Paliogen Black L0084 | 2 |
| Magenta pigment: Paliogen Red 3910HD | 0.5 |
| Cyanine pigment: NK1414 (produced by Nippon Kankoh Shikiso Kenkyusho Co., Ltd.) | 0.1 |
| Toluene | 1000 |

After dispersing and mixing the above materials, a black photoconductive toner having an average particle size of 9 to 11 μm was obtained from the mixture using a spray-dry technique.

Example 5

A black photoconductive toner was obtained in the same manner as in Example 4, except that the magenta pigment Paliogen Red 3910HD was used in 0.25 parts by weight.

Example 6

A black photoconductive toner was obtained in the same manner as in Example 4, except that the magenta pigment Paliogen Red 3910HD was used in 1.0 part by weight.

Example 7

A black photoconductive toner was obtained in the same manner as in Example 4, except that the magenta pigment Paliogen Red 3910HD was used in 1.5 parts by weight.

Example 8

A black photoconductive toner was obtained in the same manner as in Example 4, except that the magenta pigment Paliogen Red 3910HD was used in 2.0 parts by weight.

Example 9

A black photoconductive toner was obtained in the same manner as in Example 4, except that Chromofine Magenta MT201 (produced by Dainichi Seika Co., Ltd.) was used instead of the magenta pigment Paliogen Red 3910HD.

Example 10

A black photoconductive toner was obtained in the same manner as in Example 4, except that Hostapern Pink E-02 (produced by Hoechst Co., Ltd.) was used instead of the magenta pigment Paliogen Red 3910HD.

Example 11

A black photoconductive toner was obtained in the same manner as in Example 4, except that Brilliant Carmine FB Pure (produced by Yamazaki Co., Ltd.) was used instead of the magenta pigment Paliogen Red 3910HD.

Example 12

A black photoconductive toner was obtained in the same manner as in Example 4, except that Permanent Pink (produced by Sanyo Co., Ltd.) was used instead of the magenta pigment Paliogen Red 3910HD.

Example 13

A black photoconductive toner was obtained in the same manner as in Example 4, except that Perylene Red (produced by Mikuni Co., Ltd.) was used instead of the magenta pigment Paliogen Red 3910HD.

Example 14

A black photoconductive toner was obtained in the same manner as in Example 4, except that Paliogen Red 3870HD (produced by BASF Co., Ltd.) was used instead of the magenta pigment Paliogen Red 3910HD.

Next, the toners obtained in Examples 4–14 were measured in the same manner as in Example 1, for their respective surface potential attenuation rates and electric charges of the toners. The results are shown in Table 2.

TABLE 2

| | Electric charge (μc/g) | Surface potential attenuation rate (%) | Image density |
|---|---|---|---|
| Example 4 | 11 | 75 | 0.9 |
| Example 5 | 10 | 73 | 1.2 |
| Example 6 | 10 | 72 | 1.1 |
| Example 7 | 9 | 70 | 1.0 |
| Example 8 | 9 | 65 | 0.8 |
| Example 9 | 11 | 75 | 0.9 |
| Example 10 | 10 | 75 | 0.8 |
| Example 11 | 12 | 75 | 0.8 |
| Example 12 | 11 | 75 | 0.8 |
| Example 13 | 11 | 75 | 0.9 |
| Example 14 | 11 | 75 | 0.9 |

It can be seen from Table 2 that each black photoconductive toner containing the perylene black pigment and magenta pigment demonstrates excellent electrification property and photosensitivity and provides a good toner hue, thus assuring production of a clear image having a high image density.

Example 15

| Component | Parts by weight |
|---|---|
| Zinc oxide: Grade#2 (produced by Hakusui Kagaku Co., Ltd.) | 100 |
| Styrene-acryl resin: PA-525 (produced by Mitsui Toatsu Chemical Co., Ltd.) | 33 |
| Quinone dye (three color mixture containing no functional groups): TON106 produced by Mitsui Toatsyu Chemical Co., Ltd.) | 4 |
| Cyanine pigment: NK1414 (produced by Nippon Kankoh Shikiso Kenkyusho Co., Ltd.) | 0.1 |
| Toluene | 1000 |

After dispersing and mixing the above materials, a black photoconductive toner having an average particle size of 10 to 11 μm was obtained from the mixture using a spray-dry technique.

Example 16

A black photoconductive toner was obtained in the same manner as in Example 15, except that the quinone dye was used in 1 part by weight.

Example 17

A black photoconductive toner was obtained in the same manner as in Example 15, except that the quinone dye was used in 3 parts by weight.

Example 18

A black photoconductive toner was obtained in the same manner as in Example 15, except that the quinone dye was used in 5 parts by weight.

Comparative Example 7

A black photoconductive toner was obtained in the same manner as in Example 15, except that a three color dye mixture TON102 (produced by Mitsui Toatsu Chemical Co., Ltd.) having functional groups was used instead of the quinone dye (three color mixture having no functional groups).

Next, the black photoconductive toners obtained in Examples 15–18 and Comparative Example 7 were measured in the same manner as in Example 1, for their respective surface potential attenuation rates and electric charges of the toners. The results are shown in Table 3.

TABLE 3

| | Electric charge (μc/g) | Surface potential attenuation rate (%) | Image density |
|---|---|---|---|
| Example 15 | 10 | 68 | 1.3 |
| Example 16 | 10 | 68 | 0.9 |
| Example 17 | 10 | 70 | 1.2 |
| Example 18 | 10 | 68 | 1.2 |
| Comparative Example 7 | 10 | 30 | 0.2 |

Example 19

| Component | Parts by weight |
|---|---|
| Zinc oxide: Grade#2 (produced by Hakusui Kagaku Co., Ltd.) | 100 |
| Styrene-acryl resin: PA-525 (produced by Mitsui Toatsu Chemical Co., Ltd.) | 33 |
| Perylene black pigment: Paliogen Black L0086 | 1.5 |
| Quinone dye (three color mixture): TON109 (produced by Mitsui Toatsu Chemical Co., Ltd.) | 1.5 |
| Cyanine pigment: NK3425 (produced by Nippon Kankoh Shikiso Kenkyusho Co., Ltd.) | 0.1 |
| Toluene | 1000 |

After dispersing and mixing the above materials, a black photoconductive toner having an average particle size of 10 to 11 μm was obtained from the mixture using a spray-dry technique.

Example 20

A black photoconductive toner was obtained in the same manner as in Example 19, except that the quinone dye in 2 parts by weight and the perylene black pigment in 1 part by weight was used.

Example 21

A black photoconductive toner was obtained in the same manner as in Example 19, except that the quinone dye in 2.5 parts by weight and the perylene black pigment in 0.5 parts by weight were used.

Next, the black photoconductive toners obtained in Examples 19–21 were measured in the same manner as in Example 1, for their respective surface potential attenuation rates and electric charges of the toners. The results are shown in Table 4.

TABLE 4

| | Electric charge (μc/g) | Surface potential attenuation rate (%) | Image density |
|---|---|---|---|
| Example 19 | 9 | 68 | 0.9 |
| Example 20 | 11 | 69 | 1.1 |
| Example 21 | 10 | 71 | 1.2 |

Example 23

| Component | Parts by weight |
|---|---|
| Zinc oxide colored by Erythrosine B: Grade#2 (produced by Hakusui Kagaku Co., Ltd.) | 100 |
| Styrene-acryl resin: PA-525 (produced by Mitsui Toatsu Chemical. Co., Ltd.) | 33 |
| Perylene black pigment: Paliogen Black L0086 | 1.5 |
| Quinone dye: TON109 (produced by Mitsui Toatsu Chemical Co., Ltd.) | 1.5 |
| Cyanine pigment: NK3425 (produced by Nippon Kankoh Shikiso Kenkyusho Co., Ltd.) | 0.1 |
| Toluene | 1000 |

After dispersing and mixing the above materials, a black photoconductive toner having an average particle size of 10 to 11 μm was obtained from the mixture using a spray-dry technique.

Example 23

A black photoconductive toner was obtained in the same manner as in Example 22, except that zinc oxide Grade#2 (produced by Hakusui Kagaku Co., Ltd.) colored by fluorescein was used instead of the zinc oxide Grade#2 (produced by Hakusui Kagaku Co., Ltd.) colored by Erythrosine B.

Example 24

A black photoconductive toner was obtained in the same manner as in Example 22, except that zinc oxide Grade#2 (produced by Hakusui Kagaku Co., Ltd.) colored by Bromophenol Blue was used instead of the zinc oxide Grade#2 (produced by Hakusui Kagaku Co., Ltd.) colored by Erythrosine B.

Example 25

A black photoconductive toner was obtained in the same manner as in Example 22, except that zinc oxide Grade#2 (produced by Hakusui Kagaku Co., Ltd.) colored by Erythrosine B, fluorescein, and Bromophenol Blue was used instead of the zinc oxide Grade#2 (produced by Hakusui Kagaku Co., Ltd.) colored by Erythrosine B.

Example 26

A black photoconductive toner was obtained in the same manner as in Example 22, except that the perylene black pigment was not used.

Example 27

A black photoconductive toner was obtained in the same manner as in Example 22, except that the quinone dye was not used.

Next, the black photoconductive toners obtained in Examples 22–27 were measured in the same manner as in Example 1, for their respective surface potential attenuation rates and electric charges. The results are shown in Table 5.

TABLE 5

| | Electric charge (μc/g) | Surface potential attenuation rate (%) | Image density |
|---|---|---|---|
| Example 22 | 10 | 66 | 1.0 |
| Example 23 | 9 | 68 | 0.8 |
| Example 24 | 9 | 68 | 0.9 |
| Example 25 | 10 | 70 | 1.2 |
| Example 26 | 8 | 68 | 0.9 |
| Example 27 | 9 | 68 | 0.7 |

It can be seen from Table 5 that by coloring a hypochromic inorganic photoconductive material with a sensitizer and by giving a black hue using the thus colored photoconductive material along with the perylene black pigment and/or the three-color quinone dyes, the toners can be prepared without substantially affecting their electrical characteristics as compared with the toners prepared by using a non-colored photoconductive material. It was also found that the toners of Examples 22–27 had a black hue.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A black photoconductive toner having sensitivity to light in the wavelength range of semiconductor lasers, said toner containing a resinous binder, a photoconductive material, a cyanine pigment sensitizer, and a perylene black pigment as a colorant, the content of said perylene black pigment being in the range of 1 to 30 percent by weight based on the amount of said resinous binder and said perylene black pigment being represented by the following formula (I):

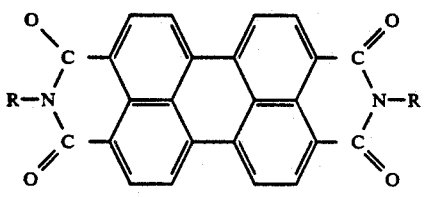

(I)

Wherein R is

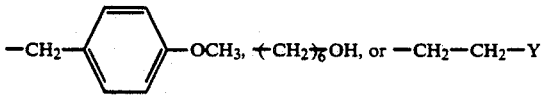

(Y represents a phenyl, methyl, or hydroxymethyl group).

2. A black photoconductive toner according to claim 1, wherein said photoconductive material is an inorganic photoconductive material.

3. A black photoconductive toner according to claim 2, wherein said inorganic photoconductive material is zinc oxide.

4. A black photoconductive toner according to claim 2, wherein said inorganic photoconductive material is colored by the sensitizer which absorbs light having wavelengths in the visible region.

5. A black photoconductive toner according to claim 1, further containing a magenta pigment.

6. A black photoconductive toner according to claim 1, further containing at least one of yellow, magenta, and cyan quinone dyes having no functional groups.

7. A black photoconductive toner having sensitivity to light in the wavelength range of semiconductor lasers according to claim 1, wherein the content of the perylene black pigment is in the range of 5 to 15 percent by weight based on the amount of the resinous binder.

8. A black photoconductive toner having sensitivity to light in the wavelength range of semiconductor lasers according to claim 1, wherein the content of the perylene black pigment is in the range of 5 to 10 percent by weight based on the amount of the resinous binder.

9. A black photoconductive toner having sensitivity to light in the wavelength range of semiconductor lasers, said toner containing a resinous binder, a photoconductive material, a cyanine pigment as a sensitizer, and yellow, magenta, and cyan quinone dyes having no functional groups as a black colorant.

10. A black photoconductive tone according to claim 9, wherein said photoconductive material is an inorganic photoconductive material.

11. A black photoconductive toner according to claim 10, wherein said inorganic photoconductive material is zinc oxide.

12. A black photoconductive toner according to claim 10, wherein said inorganic photoconductive material is colored by the sensitizer which absorbs light having a wavelength range in the visible region.

13. A black photoconductive toner according to claim 9, further comprising a perylene black pigment.

* * * * *